US008534485B2

(12) United States Patent
Van Jaarsveld

(10) Patent No.: US 8,534,485 B2
(45) Date of Patent: Sep. 17, 2013

(54) LID FOR A CAN AND METHOD FOR ORIENTATING SUCH A LID

(75) Inventor: Hein Willem Leendert Van Jaarsveld, Eefde (NL)

(73) Assignee: Impress Group B.V., AH Deventer (NL)

( * ) Notice: Subject to any disclaimer, the term of this patent is extended or adjusted under 35 U.S.C. 154(b) by 186 days.

(21) Appl. No.: 13/060,117

(22) PCT Filed: Aug. 12, 2009

(86) PCT No.: PCT/EP2009/005897

§ 371 (c)(1),
(2), (4) Date: Apr. 20, 2011

(87) PCT Pub. No.: WO2010/020375

PCT Pub. Date: Feb. 25, 2010

(65) Prior Publication Data

US 2012/0125933 A1 May 24, 2012

(30) Foreign Application Priority Data

Aug. 21, 2008 (EP) ..... 08075715

(51) Int. Cl.
*B65D 17/34* (2006.01)

(52) U.S. Cl.
USPC ..... 220/260; 220/269; 220/270; 220/906; 220/604; 220/619; 220/623; 413/12; 413/14; 413/15; 413/16; 413/17; 53/306; 53/308; 198/394; 198/533

(58) Field of Classification Search
USPC ..... 220/269, 260, 270, 906, 604, 619, 220/623, 621; 413/2, 8, 12, 14–17; 53/306, 53/308, 367, 467; 198/394, 735.3, 533
See application file for complete search history.

(56) References Cited

U.S. PATENT DOCUMENTS

| | | | | | |
|---|---|---|---|---|---|
| 3,404,800 | A | * | 10/1968 | Arfert | 220/269 |
| 3,418,956 | A | | 12/1968 | Fraze | |
| 3,625,392 | A | * | 12/1971 | Kaminski | 220/270 |
| 3,674,171 | A | * | 7/1972 | Fahlbusch | 220/270 |
| 3,724,709 | A | * | 4/1973 | Westphal | 220/273 |
| 3,730,379 | A | * | 5/1973 | Brown | 220/269 |
| 3,762,596 | A | * | 10/1973 | Henning et al. | 220/273 |
| 3,795,342 | A | * | 3/1974 | Ashton | 220/269 |
| 3,868,918 | A | * | 3/1975 | Smith et al. | 413/14 |
| 3,951,299 | A | * | 4/1976 | Khoury | 220/273 |
| 3,986,631 | A | * | 10/1976 | Ostrem | 220/270 |
| D243,833 | S | * | 3/1977 | Markert | D9/438 |
| 4,015,744 | A | * | 4/1977 | Brown | 220/269 |
| 4,266,688 | A | * | 5/1981 | Reid | 220/273 |

(Continued)

FOREIGN PATENT DOCUMENTS

| | | | |
|---|---|---|---|
| BE | 855615 | | 3/1977 |
| FR | 2704833 | * | 5/1993 |
| GB | 2192572 A | | 1/1988 |
| WO | 0009406 A1 | | 2/2000 |

*Primary Examiner* — Mickey Yu
*Assistant Examiner* — Gideon Weinerth
(74) *Attorney, Agent, or Firm* — The Webb Law Firm

(57) ABSTRACT

A lid (2) for a can (1) has a general shape defining a main plane (9) and a depression (10) arranged in the lid. The bottom wall of the depression is tilted relative to the main plane of the lid, and to a method for orientating lids.

2 Claims, 3 Drawing Sheets

(56) References Cited

U.S. PATENT DOCUMENTS

| | | | | | |
|---|---|---|---|---|---|
| 4,367,996 | A | * | 1/1983 | Saunders | 413/14 |
| 4,524,879 | A | | 6/1985 | Fundom et al. | |
| 5,038,956 | A | * | 8/1991 | Saunders | 220/271 |
| 5,069,356 | A | * | 12/1991 | Zysset | 220/276 |
| 5,095,681 | A | | 3/1992 | Choi | |
| 5,224,618 | A | * | 7/1993 | Garbiso | 220/269 |
| 5,335,808 | A | * | 8/1994 | Lee | 220/269 |
| D352,898 | S | * | 11/1994 | Vacher | D9/438 |
| 5,385,254 | A | * | 1/1995 | Hannon | 220/269 |
| 5,482,175 | A | * | 1/1996 | Arrar | 220/203.08 |
| 5,655,678 | A | * | 8/1997 | Kobayashi | 220/269 |
| 5,713,481 | A | * | 2/1998 | Jordan | 220/271 |
| 5,813,811 | A | * | 9/1998 | Saunders | 413/16 |
| D432,015 | S | * | 10/2000 | Holiday | D9/772 |
| 6,138,856 | A | * | 10/2000 | Ghim et al. | 220/269 |
| 6,164,480 | A | * | 12/2000 | Heinicke et al. | 220/269 |
| 6,202,881 | B1 | * | 3/2001 | Chiang | 220/269 |
| 6,244,455 | B1 | * | 6/2001 | Lastik | 220/254.3 |
| 6,253,946 | B1 | * | 7/2001 | Makinen | 220/268 |
| 6,386,813 | B1 | * | 5/2002 | Huber et al. | 413/12 |
| 6,739,471 | B2 | * | 5/2004 | Goetz et al. | 220/258.4 |
| 7,174,762 | B2 | * | 2/2007 | Turner et al. | 72/348 |
| 7,500,577 | B2 | * | 3/2009 | Wichelhaus | 220/254.4 |
| D600,118 | S | * | 9/2009 | Brehelin | D9/438 |
| D634,193 | S | * | 3/2011 | Draxler | D9/438 |
| 7,942,285 | B2 | * | 5/2011 | Hasegawa et al. | 220/269 |
| 8,235,244 | B2 | * | 8/2012 | Bulso | 220/623 |
| 8,371,467 | B2 | * | 2/2013 | Jeon | 220/270 |
| 2004/0065663 | A1 | * | 4/2004 | Turner et al. | 220/254.1 |
| 2005/0082292 | A1 | * | 4/2005 | Benge et al. | 220/270 |
| 2006/0016815 | A1 | * | 1/2006 | Rieck et al. | 220/269 |
| 2008/0197132 | A1 | * | 8/2008 | Hasegawa et al. | 220/269 |
| 2008/0272121 | A1 | * | 11/2008 | Rosentreler | 220/269 |
| 2009/0084789 | A1 | * | 4/2009 | Higashimoto | 220/269 |
| 2010/0028104 | A1 | * | 2/2010 | Heinicke | 413/8 |
| 2010/0116374 | A1 | * | 5/2010 | Wilson et al. | 141/6 |
| 2010/0126994 | A1 | * | 5/2010 | Tielbeke et al. | 220/273 |
| 2010/0163560 | A1 | * | 7/2010 | Leboucher | 220/285 |
| 2010/0183406 | A1 | * | 7/2010 | Gysi et al. | 413/14 |
| 2011/0139782 | A1 | * | 6/2011 | Cherian | 220/269 |
| 2011/0308202 | A1 | * | 12/2011 | Hall | 53/467 |
| 2012/0279967 | A1 | * | 11/2012 | Leboucher | 220/265 |

* cited by examiner

LID FOR A CAN AND METHOD FOR ORIENTATING SUCH A LID

BACKGROUND OF THE INVENTION

The invention relates to a lid for a can, the lid having a general shape defining a main plane and a depression arranged in the lid.

Such lids are used for cans in the food and beverage industry. A may be formed out of tin plate, electro chromium coated steel or aluminium. The can is filled with for example food or a liquid and then the lid is arranged on top of the can to seal off the can.

Such lids are in cases provided with a print and may have to be oriented in relation to the can. Orientation of the lid could also be necessary for other process steps. With lids of for example a substantially circular shape, it is not possible to mechanically orientate such lids. It is common to use a vision system in which a camera takes an image of the lids being supplied on for example a conveyor belt, after which the image is processed and the orientation of each lid is determined. Then the lid will be orientated with suitable means in order to have the print in the same orientation as the can when entering into a machine. In another application of lids for cans, the depression is provided in the can and functions as a finger well. This provides finger access and facilitates gripping of the pull tab. It would be preferred to have a deep depression as a finger access. However, this would have a negative effect on the stackability of the lid. The deep depression could rest in a stack of lids on an portion of the underlying lid, for example onto the pull tab, which results in lids not being nested correctly reducing the stackability of the lids. It is therefore common in the field to minimize the depth of a finger well in order not to reduce the stackability of the lids.

If however, the lids could be orientated easily it would be possible to have deeper finger wells, because by correctly mutually orientating the lids within a stack the deeper depressions would not rest on a pull tab but in a depression of an underlying lid. Accordingly, the stackability is not reduced.

SUMMARY OF THE INVENTION

It is an object of the invention to provide an elegant solution for orientating lids provided with a depression. This object is achieved by a lid according to the invention, which is characterized in that the bottom wall of the depression is tilted relative to the main plane of the lid.

Preferably the general shape is substantially circular.

By tilting the bottom wall of the depression a slope is created along which the lid can slide to a more flat position over an underlying lid or formed supporting surface. If for example the depression would rest with the deepest part on a pull tab of an underlying lid, the top lid could slide downwardly while rotating, such that a more shallow part of the depression will rest on the pull tab. This reduces the stack height and provides for a better stacking of the lids. In order to promote the sliding of the lid a vibration can be introduced, which overcomes the friction and makes sure that the lids will slide along the surface and have an optimum orientation in relation to each other to provide the best stacking configuration.

In the case the lids have to be orientated, for example due to a print, the same principle can be used. Instead of an underlying similar lid, a special surface can be used.

It is noted that the slope of the tilted bottom wall does not need to be constant but may vary while defining a deepest part and a more shallow part in the depression.

It is noted that the orientation of the lid relative to other lids and/or the can may be accomplished with any suitable means, such as rotation, vibration or directly by lid or can manipulation using a gripper or magnets.

In a preferred embodiment of the lid, the lid is provided with a score line defining a tear-out portion and a pull tab arranged on the tear-out portion. Such lids are commonly known as easy opening ends. In particular with such lids it is generally difficult to get a good grip onto the pull tab in order to open the tear-out portion. By providing a deep finger well underneath the pull tab, the pull tab can easily be gripped and the tear-out portion can be removed from the lid.

Preferably, the pull tab extends in such a case at least partially over the depression.

In yet another embodiment of the lid according to the invention the free end of the pull tab ends before the center of the lid. If the free end would extend beyond the center, it would be possible that the bottom wall of the depression rests fully onto the pull tab, which would prevent sliding of the lid along an underlying pull tab.

In yet another embodiment of the lid according to the invention, the depression is substantially circular.

Preferably, the depression extends beyond the center of the lid.

In still another embodiment the tilted bottom wall of the depression is arranged such, that by rotating the lid a state of lower entropy can be achieved.

The invention also relates to a method for orientating lids according to the invention, the method comprising the steps of:

- providing a support surface for supporting the circumferential edge of the lid;
- providing a second support for supporting a portion of the tilted bottom wall, wherein the contact area of the second support and the bottom wall is off-center of the lid; and
- vibrating the lid and/or the supports, such that the lid is rotated.

Having a lid with a depression according to the invention it is possible to orientate such a lid based on the tilted bottom wall of the depression. According to the method of the invention the circumferential edge of the lid is supported such that the lid can rotate and a second support is provided which rests against the bottom wall. Upon vibration of the lids and/or the support, the lid will urge to acquire a position in which it has a lower state of energy. This principle is the same as with a sphere, which tends to roll down a slope towards the lowest point. This principle is also called entropy.

As with the method according to the invention in which the lid and/or support are vibrated the lid tends to rotate to a position of lower energy, the lid will always become orientated into a certain position. When the lids are arranged into a stack, this will mean that the lids will tend to an arrangement in which the lids are stacked the most compact.

In a preferred embodiment of the method according to the invention, the bottom wall is provided with a notch and the vibrating of the lid and/or the support causes the second support to register with the notch. By providing a notch it is possible to define an exact position of the lid. The tilted bottom wall of the depression will make sure that the lid will rotate to a position of lower energy (entropy) and the notch makes sure that as soon as the desired position is reached, the lid is locked into this position as the second support will register with the notch.

BRIEF DESCRIPTION OF THE DRAWINGS

These and other features of the invention will be elucidated in conjunction with the accompanying drawings.

DESCRIPTION OF THE PREFERRED EMBODIMENTS

Figure 1:
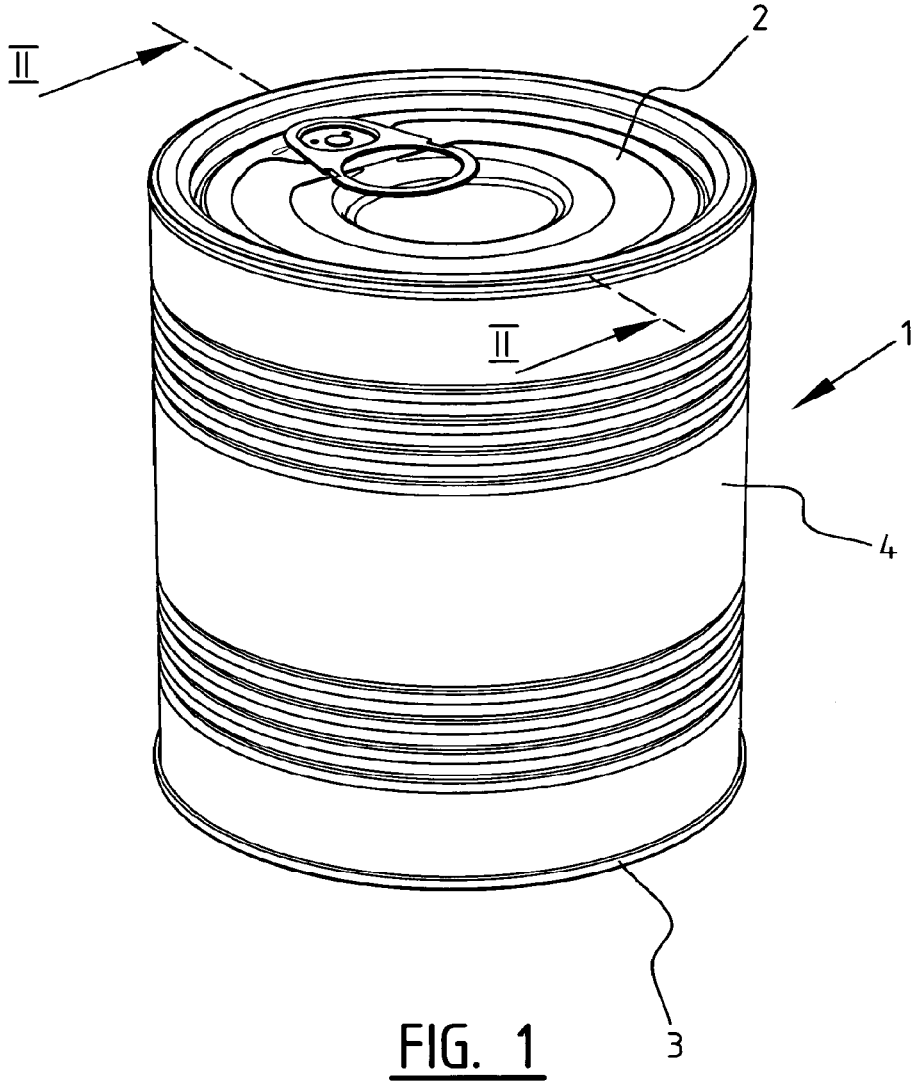
FIG. 1 shows a perspective view of a can with a lid according to the invention.

FIG. 1 shows a can 1 with a lid 2 according to the invention. The can 1 has a bottom wall 3 and a circumferential wall 4.

Figure 2A:
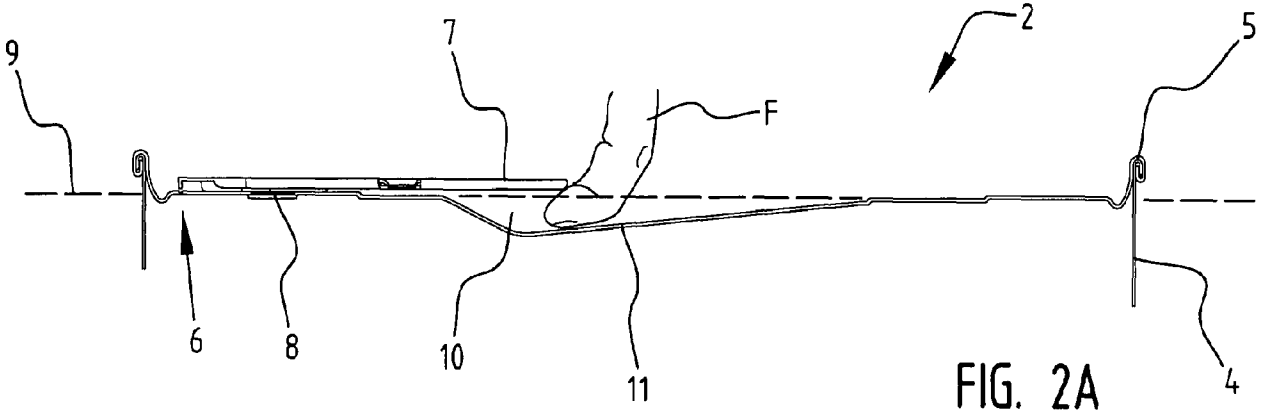
FIGS. 2A and 2B show a cross-sectional view of the tin can according to FIG. 1.
Figure 2B:
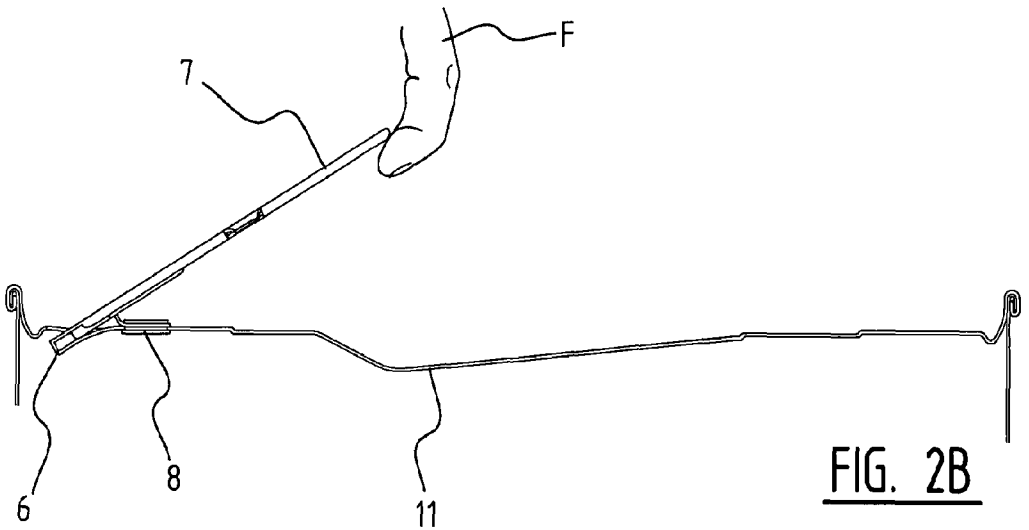

In FIG. 2 a cross-sectional view of the lid 2 is shown.

The lid 2 has a substantially circular shape with a circumferential seamed edge 5. The lid 2 is provided with a score line 6 and a pull tab 7 which is connected to the lid 2 via a rivet 8.

The lid 2 has an imaginary main plane 9. A depression 10 is arranged in the lid 2 having a bottom wall 11 which is tilted relative to this main plane 9, with the deepest part beneath the tab 7.

This depression 10 or finger well enables a finger F to grip the free end of the pull tab 7 and to pull up the pull tab 7 such that the score line 6 brakes. Subsequently by pulling the pull tab 7 a portion of the lid 2 can be torn-out.

Figure 3:
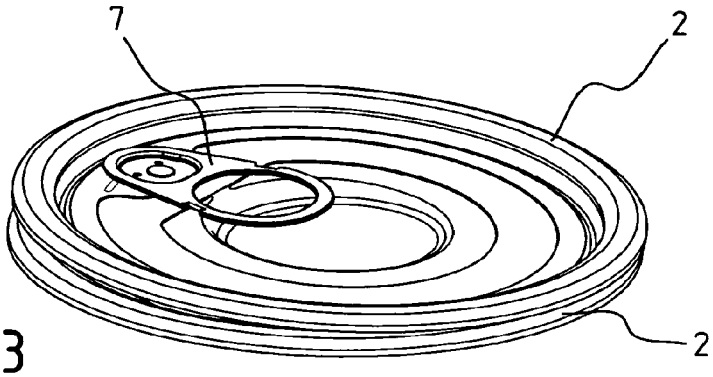
FIG. 3 shows two lids according to the invention stacked onto each other in a high energy state.

In FIG. 3 two lids 2 are arranged on top of each other having an identical orientation such that the pull tabs 7 of the lids 2 are directly on top of each other.

Figure 4:
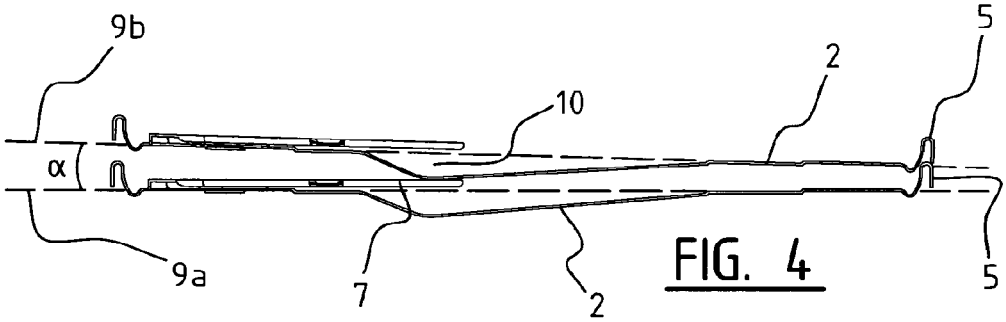
FIG. 4 shows a cross-sectional view of the lid according to FIG. 3.

In FIG. 4 it is clearly shown that the top lid 2 rests partially with the circumferential edge 5 onto the circumferential edge 5 of the bottom lid 2. The top lid 2 furthermore rests with the deepest portion of the finger well 10 onto the free end of the pull tab 7 of the bottom lid 2. This results in that the main plane 9*a*, 9*b* of each lid 2 are not parallel to each other.

Figure 5:
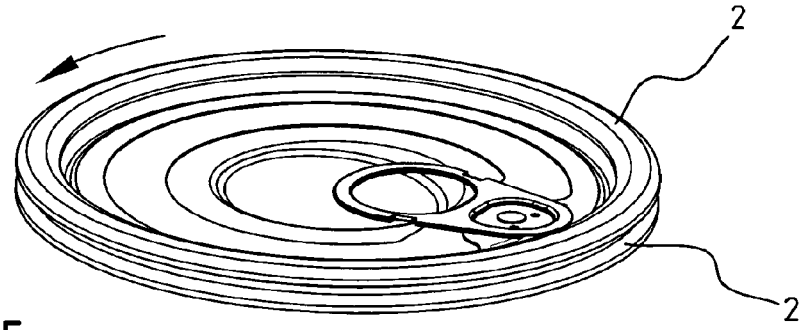
FIG. 5 shows the lids of FIG. 3 in a position of lower energy.
Figure 6:
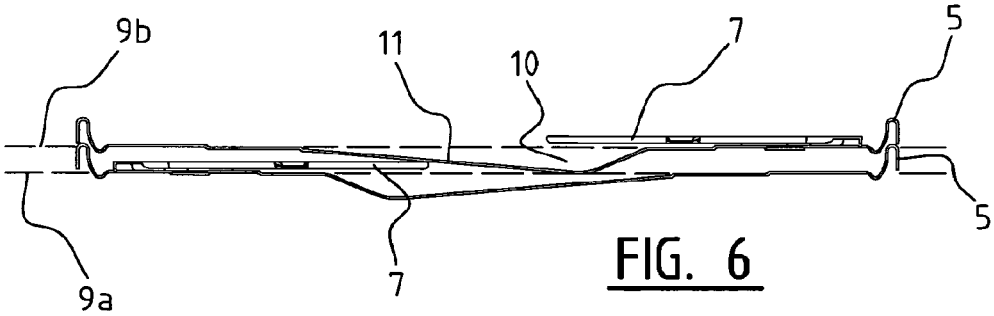
FIG. 6 shows a cross-sectional view of FIG. 5.

Now by vibrating the stack of lids 2 the lids will start to rotate in the direction of the arrow (see FIG. 5) such that the contact point between the deepest portion of the depression t10 of the top lid 2 and the pull tab 7 of the bottom lid 2 will move from the deepest portion of the finger well 10 to a more shallow portion of the finger well 10 (see FIG. 6).

In FIG. 6 a cross-sectional view is shown in which the top lid 2 has rotated as a result of the vibrating action relative to the bottom lid 2. As is clear from the cross-section, the pull tabs 7 are not directly on top of each other, but are positioned diametrically opposite each other. It is clear that the free end of the pull tab 7 of the bottom lid 2 now contacts a more shallow portion of the finger well 10 at the bottom wall 11. In this condition the circumferential edges 5 rest on top of or have a closer distance to each other along the full circumference of the lids 2. In this position the main planes 9*a*, 9*b* are parallel to each other.

Instead of using an underlying lid 2 it is also possible to use a dedicated surface onto which a single lid 2 can be orientated.

The invention claimed is:

1. A lid for a can, comprising:

a wall having a main plane with a center, and an inclined depression tilted relative to the main plane of the lid, the depression including a deepest part;

a score line defining a tear-out portion;

and a pull tab arranged on the tear-out portion, having a ring-shaped free end, the free end including a center portion;

wherein, the free end of the pull tab ends before the center of the wall; and the depression extends beyond the center of the wall; and the pull tab extends at least partially over the depression such that the deepest part of the depression is beneath the center of the ring-shaped portion of the pull tab, so that when a plurality of lids are arranged in a stack, each pull tab would register with the depression of the lid above or below it, resulting in a stack of vertical and parallel lids in which the pull tabs face in alternating opposite directions.

2. The lid according to claim 1, wherein the lid is substantially circular.

* * * * *

UNITED STATES PATENT AND TRADEMARK OFFICE

CERTIFICATE OF CORRECTION

PATENT NO. : 8,534,485 B2
APPLICATION NO. : 13/060117
DATED : September 17, 2013
INVENTOR(S) : Hein Willem Leendert Van Jaarsveld It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 246 days.

Signed and Sealed this
Fifteenth Day of September, 2015

Michelle K. Lee

Michelle K. Lee
*Director of the United States Patent and Trademark Office*